US006592277B2

(12) United States Patent
Kashiwaba et al.

(10) Patent No.: US 6,592,277 B2
(45) Date of Patent: Jul. 15, 2003

(54) LABEL ROLL CORE HOLDER ASSOCIATED SYSTEM AND LABEL REGULATING GUIDE IN LABELER

(75) Inventors: Tadao Kashiwaba, Tokyo (JP); Tadashi Sasaki, Tokyo (JP)

(73) Assignee: Kabushiki Kaisha Sato (JP)

( * ) Notice: Subject to any disclaimer, the term of this patent is extended or adjusted under 35 U.S.C. 154(b) by 0 days.

(21) Appl. No.: 10/166,139

(22) Filed: Jun. 10, 2002

(65) Prior Publication Data

US 2002/0192002 A1 Dec. 19, 2002

Related U.S. Application Data

(62) Division of application No. 09/701,553, filed on Nov. 29, 2000, now Pat. No. 6,447,185.

(30) Foreign Application Priority Data

Mar. 30, 1999 (JP) ..... 11-88834

(51) Int. Cl.[7] ..... B41J 1/56; B41J 11/26; B41J 47/46; B41F 1/08

(52) U.S. Cl. ..... 400/613; 242/100; 101/93; 101/288; 156/541; 156/584; 400/174; 400/88

(58) Field of Search ..... 101/93, 288; 156/DIG. 24, 156/DIG. 26, 584, 541; 400/88, 174, 613; 242/100

(56) References Cited

U.S. PATENT DOCUMENTS

| | | | | |
|---|---|---|---|---|
| 3,522,131 A | | 7/1970 | Yo Sato et al. | 156/384 |
| 3,957,562 A | * | 5/1976 | Hamisch, Jr. | 156/384 |
| 4,224,872 A | * | 9/1980 | Sato | 101/288 |
| 4,233,900 A | * | 11/1980 | Sato | 101/288 |
| 4,668,326 A | | 5/1987 | Mistyurik | 156/384 |
| 4,954,208 A | | 9/1990 | Hamisch, Jr. | 156/577 |
| 5,800,669 A | | 9/1998 | Goodwin | 156/577 |
| 5,934,189 A | * | 8/1999 | Mistyurik et al. | 101/93 |
| 5,988,249 A | * | 11/1999 | Mistyurik et al. | 156/384 |

FOREIGN PATENT DOCUMENTS

| | | | |
|---|---|---|---|
| EP | 0858950 | 8/1998 | 11/2 |
| GB | 2179326 | 3/1987 | 11/2 |
| GB | 2201661 | 9/1988 | 11/2 |
| JP | 61259941 | 11/1986 | |
| JP | 3050585 | 5/1998 | |
| JP | 11-91753 | 4/1999 | |
| JP | 2-19238 | 5/1999 | |

* cited by examiner

*Primary Examiner*—Andrew H. Hirshfeld
*Assistant Examiner*—Marvin P. Crenshaw
(74) *Attorney, Agent, or Firm*—Ostrolenk, Faber, Gerb & Soffen, LLP

(57) ABSTRACT

A printing labeler having a label restraining and guiding system with a deflection member for turning back only the backing sheet of a continuous label strip composed of a backing sheet having a label peel-off layer and a plurality of labels provisionally attached to the backing sheet to thereby peel the labels from the backing sheet, a platen that supports lateral end portions of the deflection member, a pair of left and right side plates that support the platen and a label guide piece that faces the platen and guides the continuous label strip toward the deflection member and the label guide piece integrally has a pair of left and right engagement flange portions engageable with a pair of left and right engagement grooves formed in the pair of left and right side plates, a stop portion that connects upstream ends of the engagement flange portions and a deflection guide portion that connects downstream ends of the engagement flange portions and that a surface of the platen faces a vacant space enclosed by the engagement flange portions, the stop portion and the deflection guide portion.

5 Claims, 11 Drawing Sheets

LABEL ROLL CORE HOLDER ASSOCIATED SYSTEM AND LABEL REGULATING GUIDE IN LABELER

This is a divisional of U.S. patent application Ser. No. 09/701,553 now U.S. Pat. No. 6,447,185, filed Nov. 29, 2000 in the name of Tadao Kashiwaba and Tadashi Sasaki and entitled LABEL ROLL CORE HOLDER ASSOCIATED SYSTEM AND LABEL REGULATING GUIDE IN LABELER, which is based on PCT/JP00/01973 (WO00/58194), claiming priority to Japanese Application No. 11-88834, filed Mar. 30, 1999.

TECHNICAL FIELD

This invention relates to a label roll core holder in a labeler, particularly to a label roll core holder for holding a label roll and feeding out a label strip for label attachment, a label retraining and guiding system of a printing labeler for pressing a continuous label strip guided over a platen disposed opposite a label printer in the direction of the platen, and a label roll protective cover device.

BACKGROUND ART

Substantially all conventional labelers have label printing capability in addition to labeling capability. The label roll core holder of a labeler is required to have the following characteristics.

The first required characteristic is the ability to reliably hold the label roll and the core thereof. In particular, it is necessary to reliably hold the core under various circumstances, such as during labeler transport and use and when the label roll is changed. When the labeler is being transported after shipment from the labeler plant, for example, the packaged labeler is generally loaded with a sample label roll. The label roll must therefore be made safe from detachment from the core holder by shocks experienced during transport and handling. Further, during labeler use, the labeler is operated in the manner of swinging it downward during label printing operation and label attachment operation and the amount of operating force and shock at the time of attachment differs depending on the user. Even if the operating force differs, it is necessary to cope accordingly so as to hold the label roll stably.

The second required characteristic is that the label roll be easy to load and remove. When the label roll has been used up only the core remains in the core holder. The operations of removing the core and loading a new label roll must of course be simple. In addition, even in the course of use, a problem may occur that makes it necessary to remove the label roll for inspection or to replace it.

Even under trouble-free condition, the label roll may have to be replaced with one of a different design.

Needless to say, the first characteristic and the second characteristic are incompatible and a core holder that can provide both is needed.

There has also been a problem with the guiding and restraining section for the leading end of the label strip.

A general explanation of a conventional portable printing labeler 100 will be given with reference to FIG. 13.

FIG. 13 is a schematic vertical sectional view of the portable printing labeler 101. The printing labeler 101 comprises a pair of left and right side plates 102, a label case 103, a printer 104, a conveyance roller 105, a label presser 106, a platen 107, a pair of left and right label guide pieces 108 provided above the platen 107, a deflection member 109 constituted as a deflection pin or the like, a bottom cover 110 and a labeling roller 111. The pair of left and right label guide pieces 108, the deflection member 109, and the bottom cover 110 constitute a label restraining and guiding system 112.

The aforesaid members are retained between the pair of left and right side plates 102 by shaft-mounting or direct attachment. The label case 103 holds a continuous label strip 113 in the form of a roll and can feed out the continuous label strip 113 to supply it between the label presser 106 and the conveyance roller 105, and further between pair of left and right label guide pieces 108 and the platen 107.

The continuous label strip 113 is composed of a strip-like backing sheet 114 having a label peel-off layer and multiple labels 115 provisionally attached to the backing sheet 114.

The printer 104 effects prescribed printing on the portion of the continuous label strip 113 (label 115) located on the platen 107. Printing operation is conducted by manipulating a handle (not shown) operated by swinging it relative to the side plates 102.

Conveyance projections 116 are provided on the peripheral surface of the conveyance roller 105 to be engageable with the continuous label strip 113 supplied between the conveyance roller 105 and the label presser 106. When the printer 104 is moved downward by the aforesaid handle operation (operation of printing on the label 115), the conveyance roller 105 rotates synchronously around a rotation shaft 117 to feed out the continuous label strip 113 in the direction of the platen 107, peel off the label 115 at the deflection member 109 located at the tip of the platen 107, and further feed the backing sheet 114 from which the label 115 was peeled to the rear. The platen 107 allows passage of the continuous label strip 113 on its front side and of the label 115 on its rear side and serves as a plate for the printing of the continuous label strip 113 (label 115) by the printer 104.

The pair of left and right label guide pieces 108 are made of a metal such as iron and are fixed on the inner sides of the side plates 102 to be position above the platen 107. Each label guide piece 108 is composed of a platen-side flat guide section 118 and a deflection member-side inclined section 119. The platen-side flat guide sections 118 face the platen 107 from above and guide the left and right edge portions of the continuous label strip 113 by pressing them toward the platen 107.

The deflection member-side inclined section 119 is inclined downward slightly at the tip of the platen-side flat guide section 118.

The deflection member 109 is mounted at the tip of the platen 107. Only the backing sheet 114 of the continuous label strip 113 is turned back at the deflection member 109 and the label 115 peels off the backing sheet 114 owing to its own stiffness to be positioned under the labeling roller 111.

The labeling roller 111 is supported to be rotatable around a rotation shaft 120 to enable attachment of labels 115 to the objects to be labeled (not shown). The bottom cover 110 has a sloped guide portion 121 at the tip thereof facing the deflection member 109.

The continuous label strip 113 passes along the platen-side flat guide sections 118 and the deflection member-side inclined sections 119 of the label guide pieces 108 and from the sloped guide portion 121 and the surface of the bottom cover 110. It can make a U-turn at the portion of the deflection member 109, thereby enabling the label 115 to peel from the backing sheet 114.

The platen 107 can swing open counterclockwise around the rotation shaft 117 as seen in the drawing, and the bottom cover 110 can swing open clockwise around the rotation shaft 120 as seen in the drawing. When the bottom cover 110 and the platen 107 have been swung open, continuous label strip 113 can be loaded in the printing labeler 101.

As explained in the foregoing, in order to effect smooth peeling of the label 115 from the backing sheet 114 in the foregoing manner, the label restraining and guiding system 112 restrains the continuous label strip 113 in the direction of the platen 107 and guides it in the direction of the deflection member 109.

In the portable printing labeler 101 and label restraining and guiding system 112 of this structure, the pair of left and right label guide pieces 108 and the deflection member-side inclined sections 119 of the platen-side flat guide sections 118 are repeatedly abraded by the continuous label strip 113 owing to successive conveyance and peeling of the continuous label strip 113. They therefore wear and require replacement.

Although the pair of left and right label guide pieces 108 are themselves made of metal so as to enhance their abrasion resistance, they are joined to the inner surfaces of the pair of left and right side plates 102 and are difficult to replace at the time of actual replacement. In actual practice, they are replaced with new components as a whole together with the side plates 102. This need to replace large components in their entirety only for the purpose of replacing small components like the label guide pieces 108 is a problem in terms of cost. U.S. Pat. No. 4,142,932 teaches a structure in which components corresponding to the label guide pieces 108 are made detachable from the pair of left and right side plates 102. At the time of replacing the label guide pieces, however, the side plates 102 have to be completely detached and disassembled in their entireties, whereafter reassembly is necessary. Poor efficiency is therefore a problem.

The present invention was accomplished in light of the foregoing problems and has as its object to provide a label roll core holder in a labeler, that can reliably hold a label roll and the core thereof.

Another object of the present invention is to provide a label roll core holder in a labeler, which simplifies the work of loading and the work of removing the label roll.

Another object of the present invention is to provide a label roll core holder in a labeler, that can be simply and compactly configured in a small space.

Another object of the present invention is to provide a label restraining and guiding system in a labeler, that enables the work of replacing label guide pieces to be carried out simply.

Another object of the present invention is to provide a label restraining and guiding system in a labeler, that enables the label guide pieces to be replaced alone without replacing the pair of left and right side plates in their entirety.

Another object of the present invention is to provide a label restraining and guiding system in a labeler, that at the time of replacing the label guide pieces enables the replacement work to be conducted efficiently with no need to detach and disassemble the pair of left and right side plates in their entirety.

Another object of the present invention is to provide a protective cover which, when in the closed state, prevents the label roll from being inadvertently removed from the core holder even if an operation is attempted to move it in the core removal direction.

DISCLOSURE OF THE INVENTION

Specifically, in a labeler that focuses on constituting core holding members for holding the label roll (core holding lug members) to be of pivoting type and on spring biasing the pivoting type core holding members, that has a pair of left and right side plates and a label roll conveyance path formed between the side plates and that feeds the label roll through the conveyance path as a strip to attach labels, the present invention provides a label roll core holder in a first labeler characterized in having a pair of left and right spring plates provided to face each other across a label holding space between the pair of left and right side plates and, at tips of the spring plates, a pair of left and right core holding lug members for holding the label roll, the core holding lug members each having a rotation shaft, a core holding portion adapted for holding the label roll and located nearer the label holding space than the rotation shaft, and a lug portion that is located on the opposite side of the rotation shaft from the core holding portion and projects outward of the side plate, and the spring plates being capable of supporting the core holding portions of the core holding lug members in a core holding attitude.

Auxiliary springs can be provided for supplementing the biasing force of the spring plates.

The core holding portions of the left and right core holding lug members can be given identical shapes.

The core holding portions of the left and right core holding lug members can be given different shapes.

Core retaining projections can be formed on the core holding portions of the core holding lug members.

The spring plates can be provided at locations thereof apart from said tips toward their middle portions with retaining projection portions capable of holding the core in cooperation with the core holding portions.

The label roll core holder in a labeler according the present invention is provided with the pair of left and right spring plates and the pair of left and right core holding lug members elastically biased by the spring plates. The core can therefore be held by the core holding portions of the core holding lug members and the core can be removed by operating the lug portions located on the opposite side from the core holding portion.

The label roll can be loaded by forcibly pushing it between the pair of left and right core holding lug members so as to drive it between the core holding lug members against the biasing force of the spring plates. When the label roll has been pushed inward until the hollow center portion of its core reaches the location of the core holding portions, the core holding lug members are restored to their original positions (the core holding attitude) by the biasing force of the spring plates, thereby holding the label roll.

When the label roll has been used up or when it is to be changed before being completely used, the lug portions of the core holding lug members are operated so as to pivot and tilt them as a whole and thereby form a gap sufficient for extraction of the label roll. The core can therefore be easily removed. Otherwise, the entire labeler can be turned upside down to remove the label roll from the core holder by dint of its own weight, without need for any special operation.

Further, in a label restraining and guiding system of a printing labeler that focuses on enabling a label guide piece to be constituted not as separate left and right bodies but as one of a unitary and replaceable type and on forming engagement grooves for detachably engaging the label guide piece in inner wall surfaces of a pair of left and right side plates and that has a deflection member for turning back only the backing sheet of a continuous label strip composed of a backing sheet having a label peel-off layer and a plurality of labels provisionally attached to the backing sheet to thereby peel the labels from the backing sheet, a platen that supports lateral end portions of the deflection member, a pair of left and right side plates that support the platen, and a label guide piece that faces the platen and guides the continuous label strip toward the deflection member, the present invention provides a label restraining and guiding system in a second labeler characterized in that the label guide piece integrally has a pair of left and right engagement flange portions engageable with a pair of left and right engagement grooves formed in the pair of left and right side plates, a stop portion that connects upstream ends of the engagement flange portions, and a deflection guide portion that connects downstream ends of the engagement flange portions, and that a surface of the platen faces a vacant space enclosed by the engagement flange portions, the stop portion and the deflection guide portion.

The label guide piece can be formed to be laterally symmetrical.

Projecting portions projecting inward of the side plates can be formed on the side plates above the engagement grooves.

The stop portion of the label guide piece can be formed substantially perpendicular to a plane including the engagement flange portions.

The label guide piece can be formed of synthetic resin.

The label restraining and guiding system of a printing labeler according to the present invention does not have a pair of separate left and right label guide pieces but is constituted as a replaceable insertion type unit, and engagement grooves for engagement by the label guide piece are formed in the inner wall surfaces of the pair of left and right side plates. Only slight spreading of the pair of left and right side plates enables the label guide piece to be inserted therebetween. Once the label guide piece has been fitted into the engagement grooves, the pair of left and right side plates are then reassembled in this state and fastened by tightening bolts or the like.

When the label guide piece is replaced, therefore, unlike conventionally, there is no need to entirely replace the pair of left and right side plates with new ones or to entirely detach and disassemble the pair of left and right side plates. Rather, the label guide piece can be fixed in the prescribed location merely by loosening the bolts and slightly spreading the side plates. The work of replacing the label guide piece is therefore very simple and can be conducted at low cost.

The label guide piece need not be made of metal as is the conventional practice but can instead be made of synthetic resin or other such inexpensive material.

Moreover, the protective cover device according to the present invention effectively prevents inadvertent removal of the label roll from the core holder even if an operation is effected in the core removal direction.

BEST MODE FOR CARRYING OUT THE INVENTION

A labeler 1 equipped with a label roll core holder that is a first embodiment of the present invention will now be explained with reference to FIGS. 1 to 5.

Figure 1:
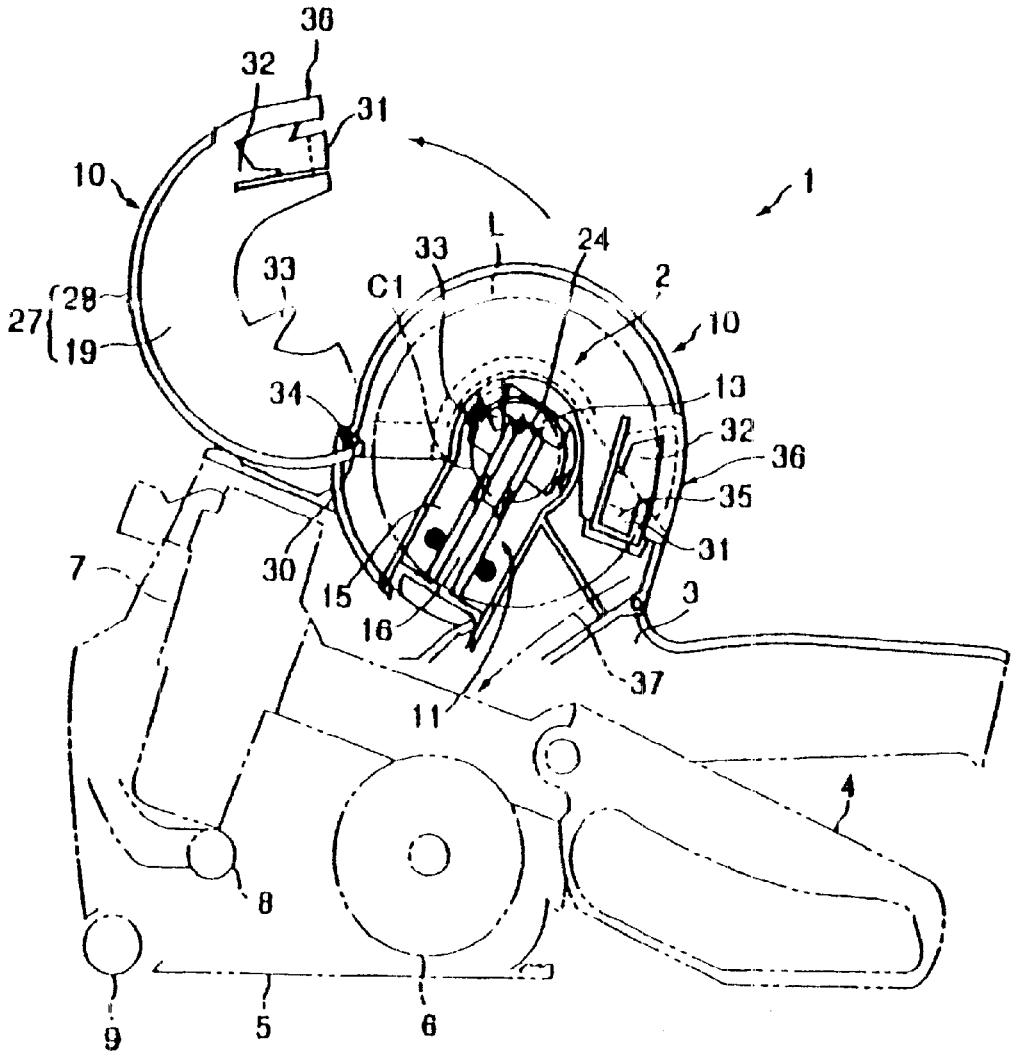
FIG. 1 is a schematic sectional side view of a labeler 1 equipped with a label roll L core holder 2 according to a first embodiment of the present invention.

FIG. 1 is a schematic sectional side view of the labeler 1 particularly showing a core holder 2 thereof. The labeler 1 has the core holder 2, a pair of left and right side plates 3, an operating lever 4, a bottom cover 5, a label conveyance roller 6, a printer 7, an ink roller 8, a labeling roller 9, and a protective cover 10 of the core holder 2. The printer 7 and the ink roller 8 are members installed in certain models or upon necessity.

Figure 2:
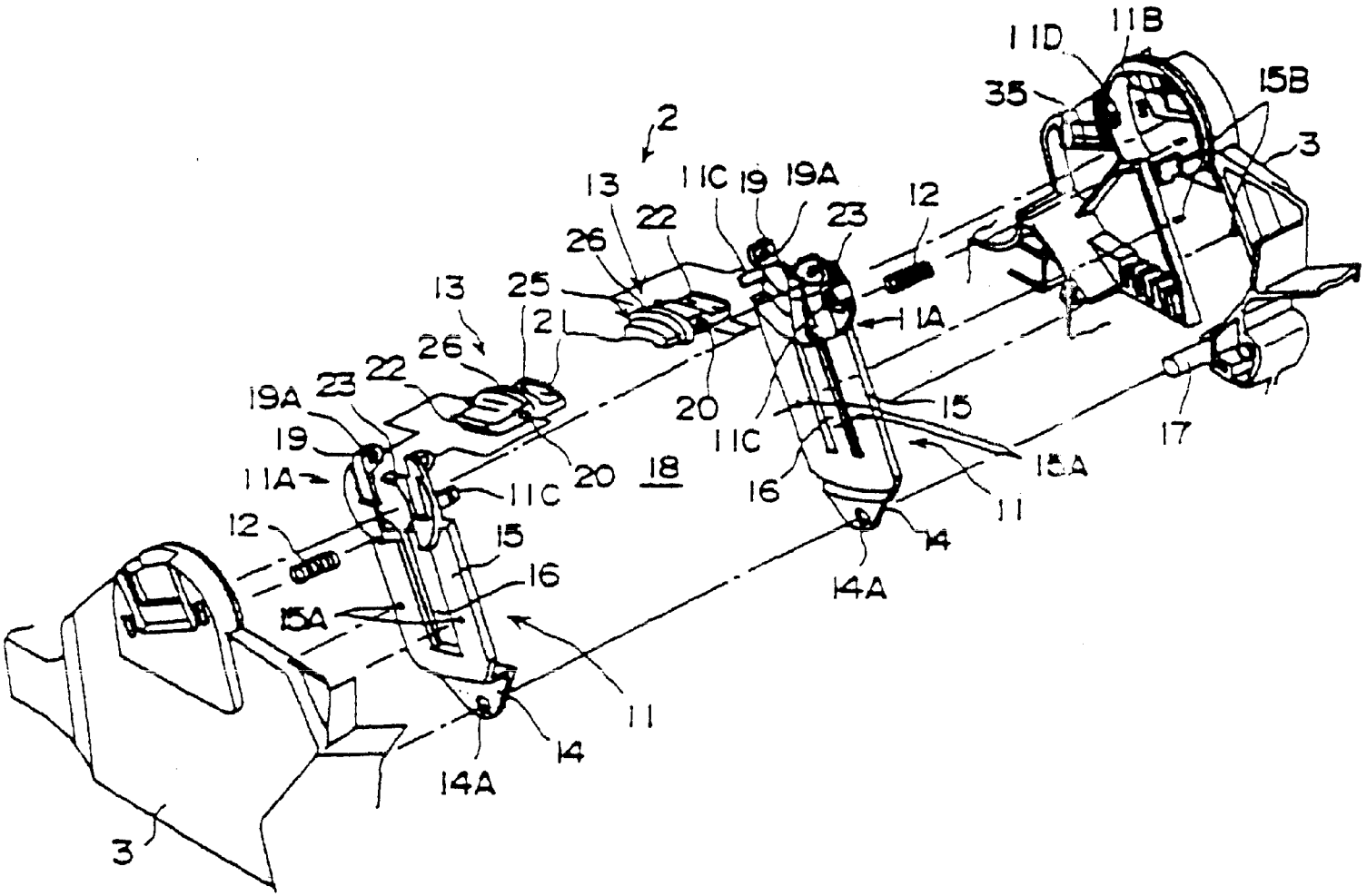
FIG. 2 is an exploded sectional view of an essential portion of the core holder 2.
Figure 3:
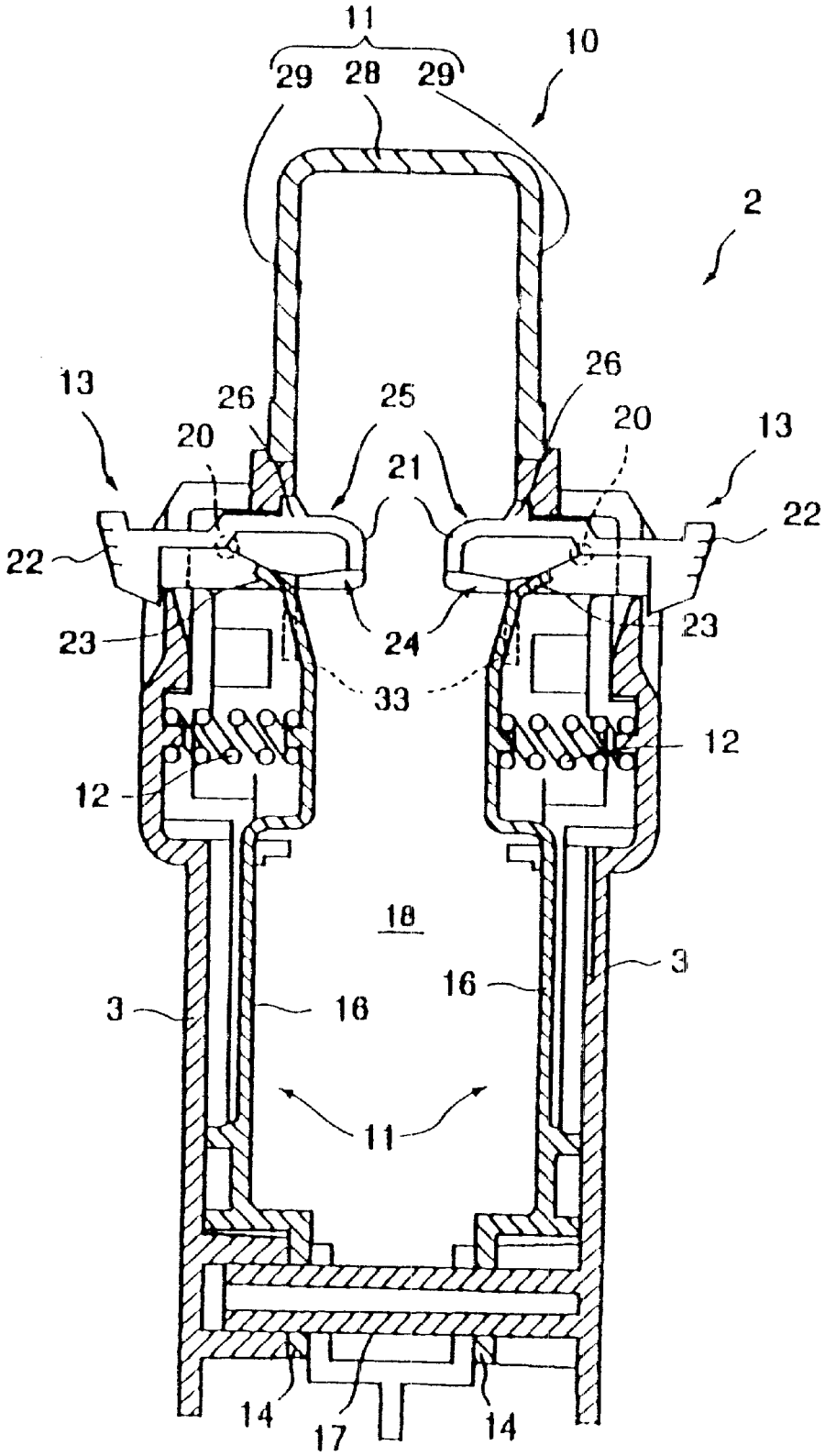
FIG. 3 is a vertical sectional view of the same.

FIG. 2 is an exploded sectional view of an essential portion of the core holder 2 and FIG. 3 is a vertical sectional view of the same. The core holder 2 has pairs of left and right spring plates 11, auxiliary springs 12, and core holding lug members 13.

Each spring plate 11 has a shaft mounting portion 14, a yoke-like shaft-supported arm 15 branching from the shaft mounting portion 14 and extending to the region of the core holding lug members 13, and an elastic abutment arm 16.

The shaft mounting portions 14 are fixed to the side plates 3 by a transverse mounting shaft 17 so that the spring plates 11 are installed in parallel with the side plates 3 so as to leave therebetween a label holding space 18 of prescribed width that, for example, enables a label roll L that is a wound paper tube (see FIG. 1 or 5) to enter between the left and right side plates 3.

The auxiliary springs 12, constituted as coil springs, are for supplementing the biasing force of the spring plates 11, particularly the elastic abutment arms 16, and, together with the spring plates 11, manifest an overall biasing force in the direction of the label holding space 18.

Each core holding lug member 13 is composed of a rotation shaft 20 rotatably engaged with a bearing portion 19 at the tip of the yoke-like shaft-supported arm 15 of the associated spring plate 11, a core holding portion 21 facing toward the label holding space 18 from the rotation shaft 20, and a lug portion 22 located on the opposite side of the rotation shaft 20 from the core holding portion 21 and projecting outward of the associated side plate 3.

Round engagement holes 19A are formed in the bearing portion 19 supporting the core holding lug member 13 of each spring plate 11. The end portions of the rotation shaft 20 on opposite sides of the core holding lug member 13 are firmly engaged with the engagement holes 19A.

The engagement holes 19A can be given the shape of the letter U lying on its side. This simplifies mounting of the core holding lug members 13 but entails a risk of the core holding lug members 13 falling out during transport.

A tip abutment portion 23 formed at the tip of each elastic abutment arm 16 abuts on a rear surface abutment portion 24 of the associated core holding portion 21 (see FIG. 3) and causes the core holding lug member 13 to project perpendicularly with respect to the side plates 3 (to assume the core holding attitude wherein it projects laterally into the label holding space 18).

The rear surface abutment portion 24 and the tip abutment portion 23 abut such that the tip abutment portion 23 can elastically deform and the two members can slide in contact with each other. Specifically, the tip abutment portion 23 makes contact with the rear surface abutment portion 24 from the side of rotation shaft 20 toward the tip end of the core holding portion 21 so as to be capable of exerting a biasing force. As the core holding portion 21 (the core holding lug member 13) rotates into the inclined core removal attitude, the elastic abutment arm 16 and the auxiliary spring 12 accumulate deformation energy. When the lug portion 22 is released, they restore the core holding lug member 13 to its original position (the core holding attitude).

The front surface at the tip of each core holding portion 21 constitutes a core holding surface 25 and a core restraining projection 26 is formed on the rotation shaft 20 side of the core holding surface 25. Specifically, the label roll L and a core C1 can be stably held between the left and right core restraining projections 26 without wobbling laterally.

Owing to the abutment of the tip portions of the core restraining projections 26 on the side plates 3, the core holding attitude of the core holding lug members 13 produced by the biasing force of the elastic abutment arms 16 and the auxiliary springs 12 can be maintained.

The core holding surfaces 25 of the left and right core holding portions 21 are provided at the same height level so that they can hold the core C1 and the label roll L parallel to the side plates 3 within the label holding space 18.

The lug portions 22 project outward of the side plates 3 and can be operated from the outside by the fingers, for example, so as to rotate and incline the core holding portions 21.

The yoke-shaped head portions 11A of the pair of spring plates 11 are fitted in recesses 11B of the side plates 3. Specifically, each core holding lug member 13 has its head portion 11A accommodated in the recess 11B of the associated side plate 3 with the bearing portion 19 in the engaged state.

Owing to the adoption of this system of insetting the spring plates 11, it is possible, particularly during assembly, to prevent the spring plates 11 from tilting inward of the labeler owing to the resilient force of the auxiliary springs 12 located between the spring plates 11 and the side plates 3.

This is advantageous in that the screw-fastening required in conventional assembly of this type can be omitted by adopting this inset system and that assembly is easier.

The transverse mounting shaft 17 linking the side plates 3 passes through engagement holes 14A bored in the shaft mounting portions 14 of the spring plates 11, and boss setting holes 15A, 15A of the spring plates 11 engage with positioning engagement projections 15B, 15B formed to project from the side plates 3, whereby reliable engagement is established between the members of each set.

Engagement hooks 11C are provided on the opposite sides of each yoke-like head portion 11A. The engagement hooks 11C make elastic engagement with engagement hook seats 11D formed inside the recess 11B of the associated side plate 3.

As shown best in FIG. 1, the protective cover 10 has a cover body 27 for covering the label roll L retained on the side plates 3 by the core holder 2. The cover body 27 has an arcuate portion 28 for covering the top of the label holding space 18 and a pair of semicircular portions 29 located on the left and right of the arcuate portion 28.

The cover body 27 further has an open/close shaft 30 formed at one end thereof, a pair of hook portions 31 formed at the opposite end of the semicircular portions 29, cover handle portions 32 formed at the base sides of the hook portions 31, and a pair of triangular projecting pieces for locking 33 formed to project inward of the semicircular portions 29.

The open/close shaft 30 is engaged with shaft supporting hole portions 34 of the side plates 3 (also see FIG. 2) and the entire protective cover 10 can be rotated in the opening and closing directions.

The hook portions 31 can engage/disengage hook engagement portions 35 of the side plates 3 to secure the cover body 27 in the closed condition. The cover body 27 can be opened by grasping the pair of cover handle portions 32 and releasing the engagement between the hook portions 31 and the hook engagement portions 35.

As shown best in FIGS. 1 and 3, when the cover body 27 is closed, the projecting pieces for locking 33 engage with the rear surface abutment portions 24 of the core holding lug members 13 from the underside in FIG. 3, thereby preventing the core holding lug members 13 from rotating around the rotation shaft 20 to assume the tilted core removal attitude and locking the core holding lug members 13 in the core holding attitude.

Specifically, when the protective cover 10 is closed, even if the core holding lug members 13 should be operated in the direction of the core removal attitude, the label roll L will not be inadvertently removed from the core holder 2 because the core holding lug members 13 are locked by the projecting pieces for locking 33.

The distal end portion of the arcuate portion 28 of the cover body 27 is cut away to form an opening portion 36, and the label roll L can be fed out from the opening portion 36 in a strip-like manner to be inserted into a conveyance path 37 formed in the labeler 1 between the pair of side plates 3.

The loading of the label roll L into the core holder 2 and the removal of the label roll L and the core C1 therefrom will now be explained with respect to the so-configured labeler 1 and core holder 2.

Figure 4:
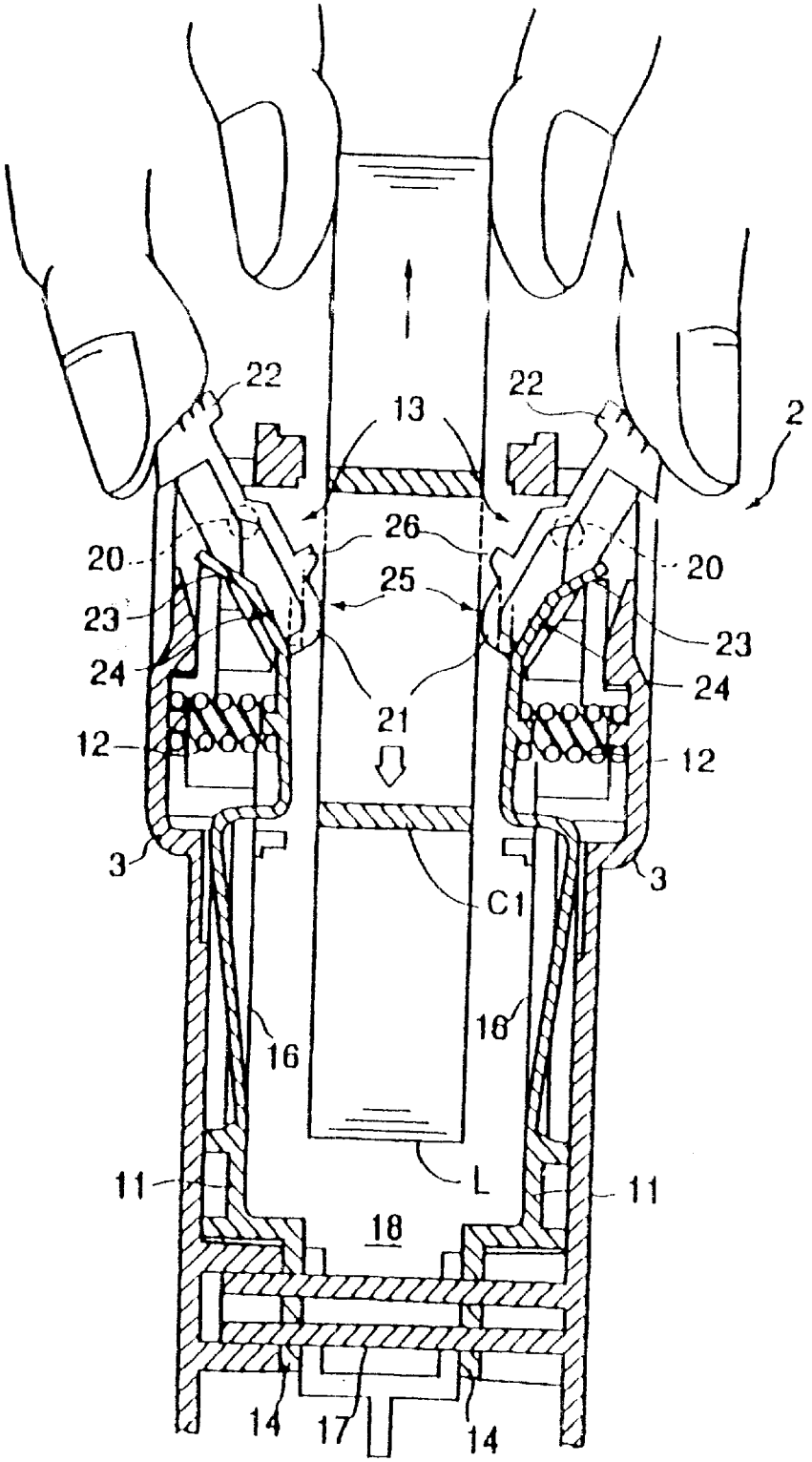
FIG. 4 is a vertical sectional view similar to that of FIG. 3 showing the case of loading a label roll L into the core holder 2 and of removing the label roll L or its core C1 therefrom.
Figure 5:
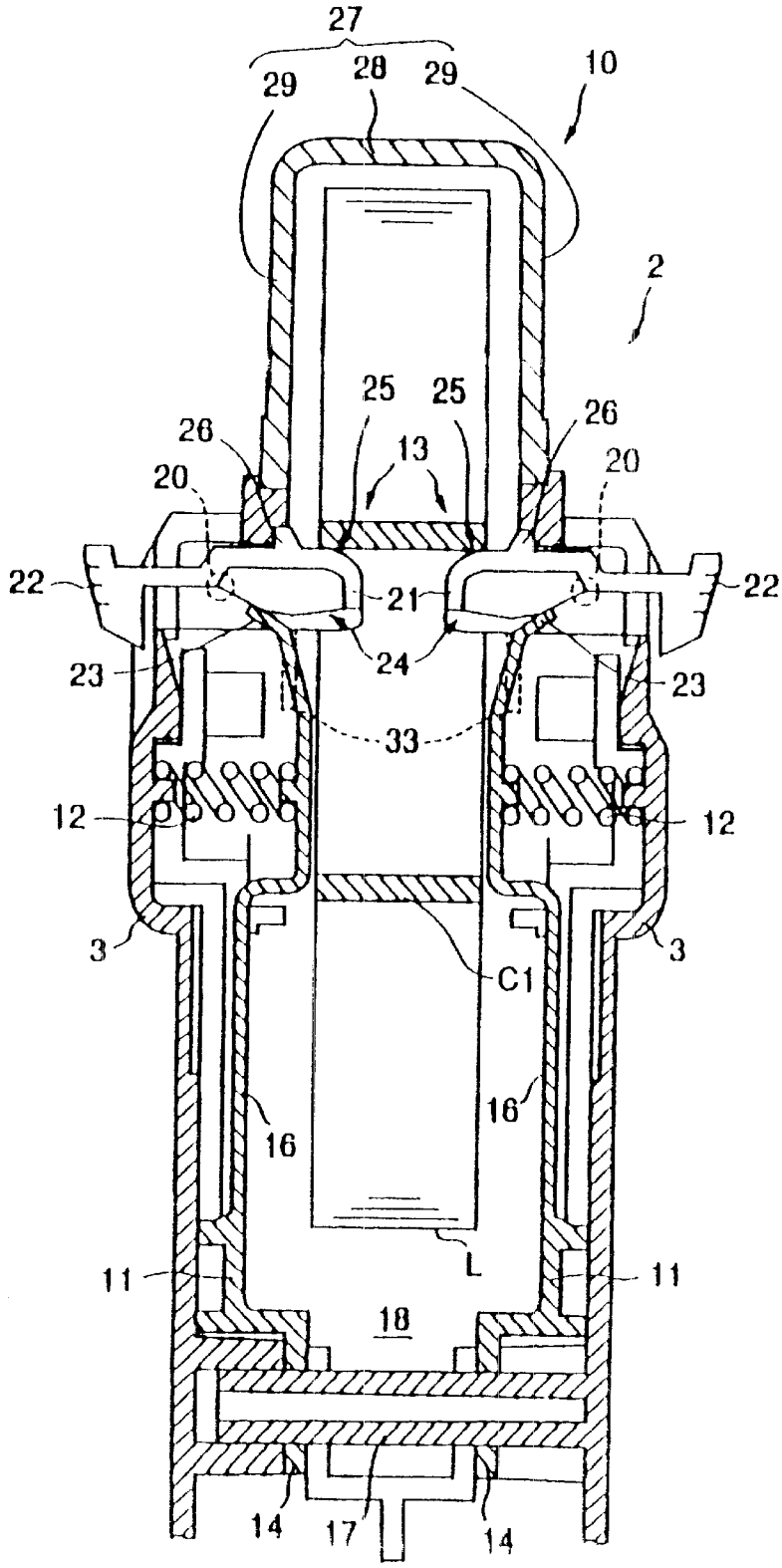
FIG. 5 is a vertical sectional similar to that of FIG. 3 showing the state after loading.

FIG. 4 is a vertical sectional view similar to that of FIG. 3 showing the case of loading a label roll L into the core holder 2 and of removing the label roll L or its core C1 therefrom. Similarly, FIG. 5 is a vertical sectional view similar to that of FIG. 3 showing the state after loading. When the protective cover 10 is opened, the engagement between the projecting pieces for locking 33 of the cover body 27 and the rear surface abutment portions 24 of the core holding lug members 13 is released. The lug portions 22 of the core holding lug members 13 can be pinched laterally with the fingers against the biasing force of the spring plates 11 (the elastic abutment arms 16) and the auxiliary springs 12 to rotate the core holding lug members 13 around the rotation shafts 20. By this, as shown in FIG. 4, the core holding lug members 13 are tilted to the left and right to enable insertion of a label roll L into the label holding space 18.

Generally, however, the loading operation is carried out not by operating the lug portions 22 but simply by immediately pressing the label roll L against the core holding portions 21 of the core holding lug members 13 (against the core holding surfaces 25) in the direction of the label holding space 18 to tilt the core holding lug members 13 toward the depth of the label holding space 18. As the label roll L enters the label holding space 18, the core holding lug members 13 readily move from their core holding attitude (FIG. 3) to their core removal attitude (FIG. 4) and then to their core holding attitude (FIG. 5), thereby simply enabling loading in the manner of FIG. 5.

When the label roll L or its core C1 is to be removed from the core holder 2, the lug portions 22 of the core holding lug members 13 are operated as shown in FIG. 5 to open the label holding space 18. The label roll L or the core C1 can then be drawn out of the label holding space 18.

In the state of FIG. 4, the label roll L or the core C1 will drop out under its own weight if the whole labeler 1 is turned upside down. This enables it to be simply removed from the label holding space 18 without directly touching it.

Figure 6:
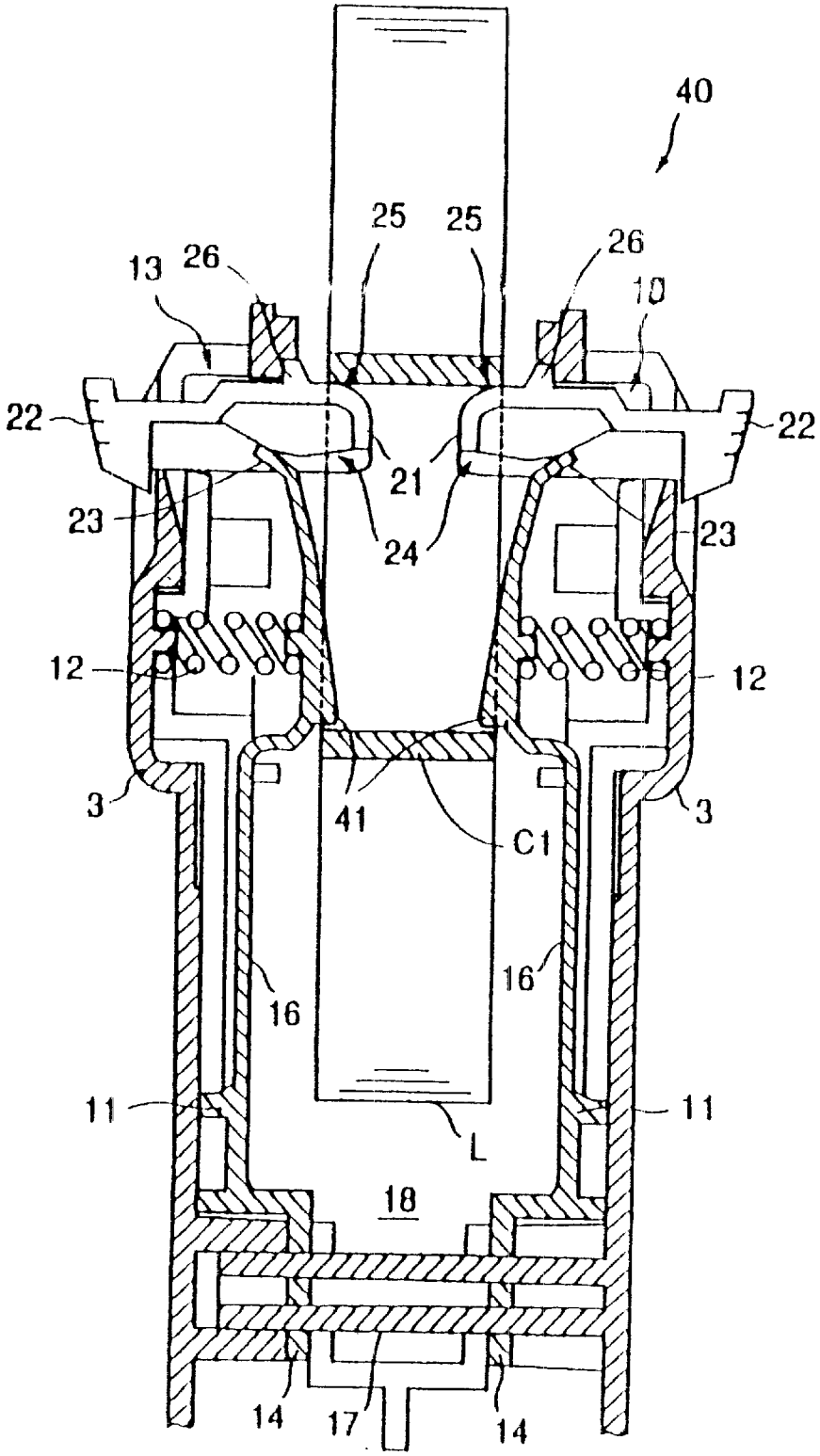
FIG. 6 is a vertical sectional view similar to that of FIG. 3 showing a core holder 40 that is a second embodiment of the present invention.

FIG. 6 is a vertical sectional view similar to that of FIG. 3 showing the case of loading a label roll L into the core holder 2 and of removing the label roll L or its core C1 therefrom. In the core holder 40, the elastic abutment arms 16 of the spring plates 11 are formed at locations inward (deeper into the label holding space 18) from their tips (the tip abutment portions 23) with retaining projection portions 41 that project into the label holding space 18.

In other aspects the structure is the same as that of the core holder 2 of FIG. 3.

The retaining projection portions 41 are provided at locations substantially corresponding to the auxiliary springs 12 on the rear side and operate in cooperation with the core holding portions 21 of the core holding lug members 13 to hold the core C1 at its lower and upper inner surface portions, respectively.

In the so-structured core holder 40, the core C1 of the label roll L is reliably held not only at the portion of the lug portions 22 of the core holding lug members 13 on the upper side in FIG. 6 but also at the retaining projection portions 41 of the elastic abutment arms 16 on the lower side. Therefore, particularly during use of the labeler 1, when it is operated with an overall downward swinging motion, the label roll L does not bounce in the core holder 40 and detachment of the label roll L or the core C1 from the portion of the core holding lug members 13 can be still more reliably prevented.

Figure 7:
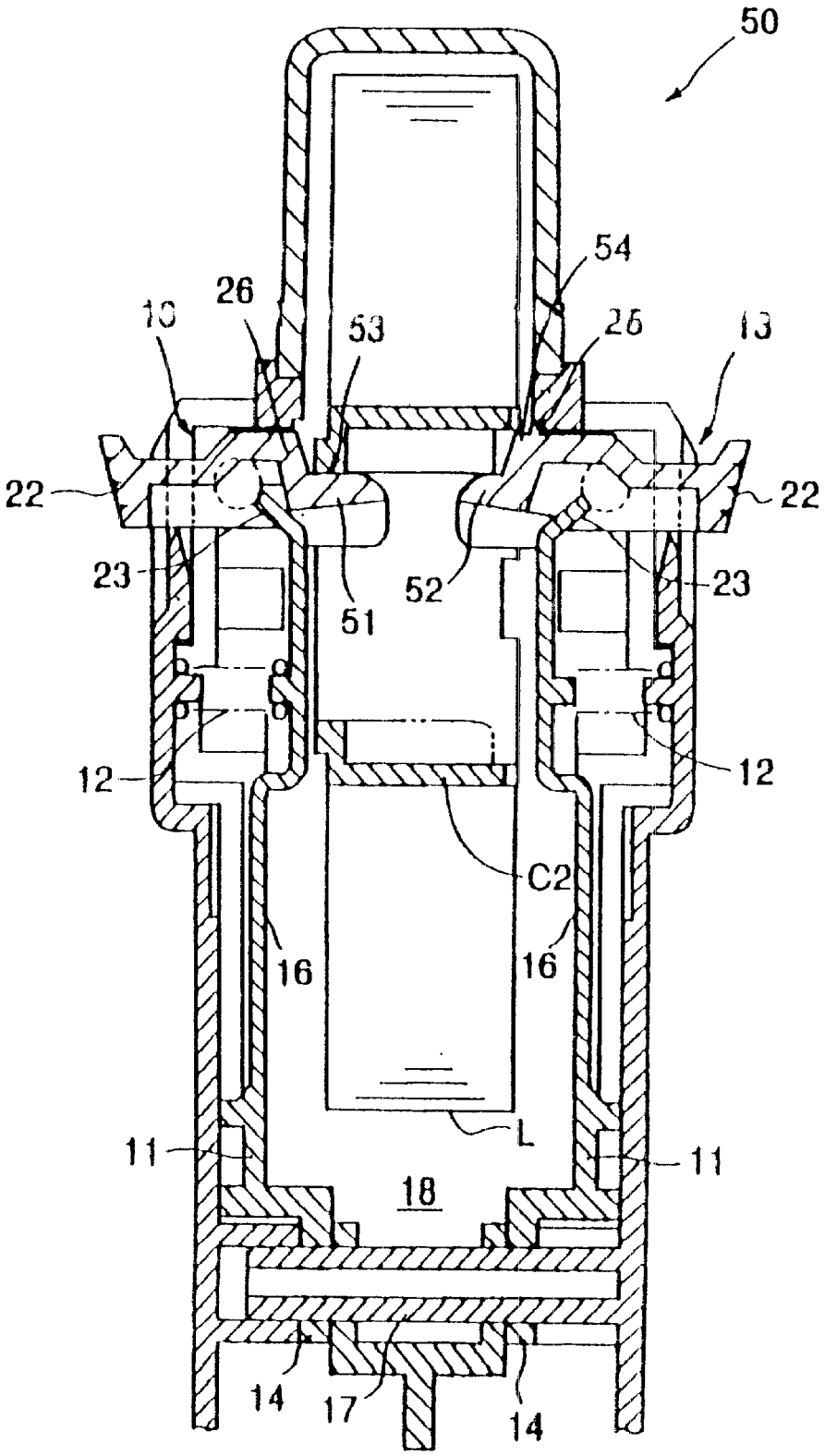
FIG. 7 is a vertical sectional view similar to that of FIG. 3 showing a core holder 50 that is a third embodiment of the present invention.

FIG. 7 is a vertical sectional view similar to FIG. 3 showing a core holder 50 that is a third embodiment of the present invention. In the core holder 50, the portions corresponding to the core holding portions 21 of the core holding lug members 13 are at each of the left and right core holding lug members constituted of a first core holder portion 51 and a second core holder portion 52.

A first core holding surface 53 of the first core holder portion 51 and a second core holding surface 54 of the second core holder portion 52 are different in height. For instance, the first core holding surface 53 is formed to be lower in height than the second core holding surface 54.

In other aspects the structure is the same as that of the core holder 2 of FIG. 3.

In the so-structured core holder 50, even if the core of the label roll L is of another type differently configured (different in inside diameter) at opposite lateral ends, such as core C2 shown in FIG. 7 made of, for example, synthetic resin, it can still be held horizontally in the label holding space 18 as a whole.

A portable printing labeler 130 equipped with a label restraining and guiding system that is another embodiment of the present invention will now be explained with reference to FIGS. 8 to 12.

Figure 13:
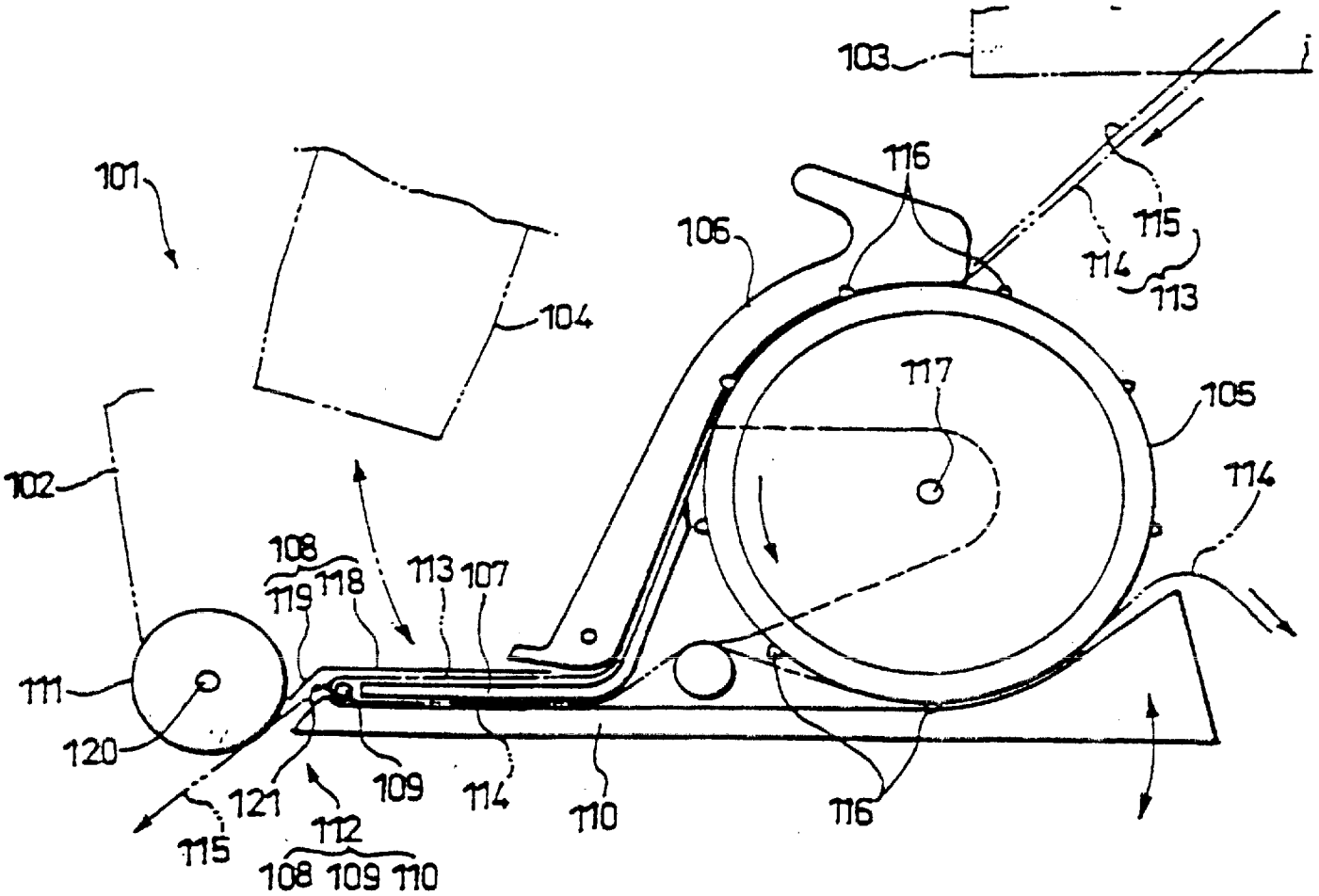
FIG. 13 is a schematic vertical sectional view of a portable printing labeler 101 equipped with a conventional label restraining and guiding system 112.

Portions similar to those in FIG. 13 are assigned the same reference symbols as those in FIG. 13 and will not be explained in detail.

Figure 8:
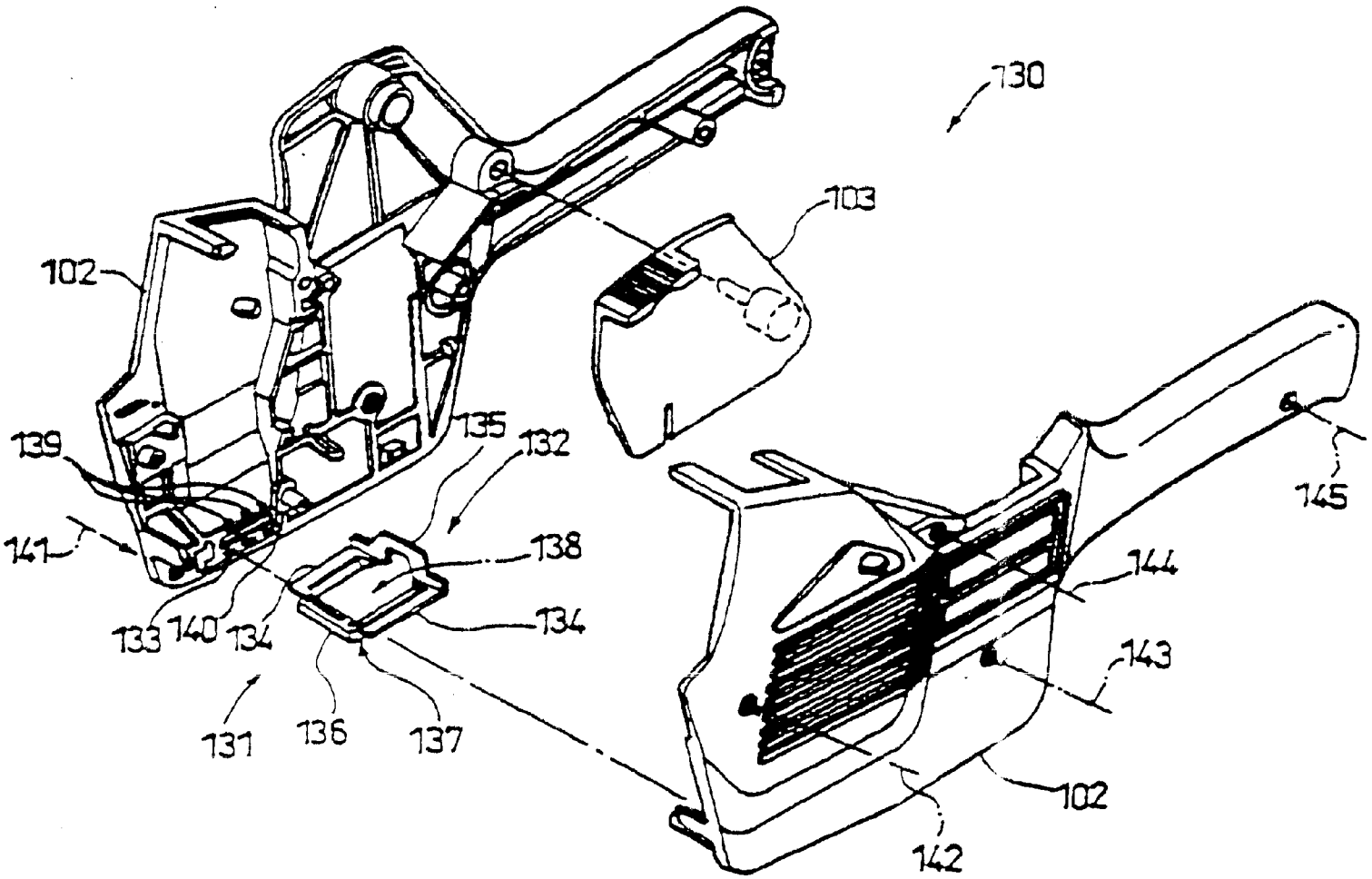
FIG. 8 is an exploded perspective view of an essential portion of a portable printing labeler 130 equipped with a label restraining and guiding system 131 that is an embodiment of the present invention.

FIG. 8 is an exploded perspective view of an essential portion of the portable printing labeler 130. The essential portion of the printing labeler 130 is the same as that of the portable printing labeler 101 of FIG. 13 except that its label restraining and guiding system 112 is an improvement on the corresponding label restraining and guiding system 112.

The label restraining and guiding system 131 has a unitary and laterally symmetrical label guide piece 132 corresponding to the aforesaid pair of left and right label guide pieces 108. The label guide piece 132 can be fitted into a pair of left and right engagement grooves 133 formed in inner wall surfaces of the pair of left and right side plates 102.

The engagement grooves 133 are formed in the inner wall surfaces of the side plates 102 slightly above the platen 107 to run parallel with the conveyance direction of the continuous label strip 113 and the platen 107. The label guide piece 132 is integrally formed of synthetic resin to comprise a pair of left and right engagement flange portions 134, a stop portion 135 and a deflection guide portion 136.

The pair of left and right engagement flange portions 134 fit into the pair of left and right engagement grooves 133.

Figure 9:
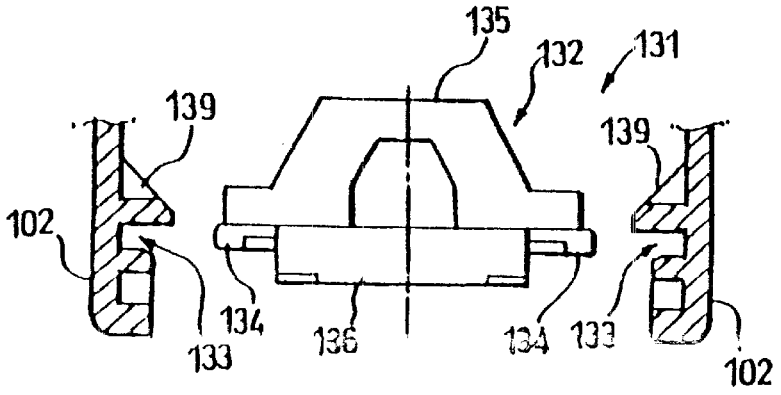
FIG. 9 is a vertical sectional view of the label restraining and guiding system 131 portion taken perpendicular to the conveyance direction of a continuous label strip 113 and showing the state before a label guide piece 132 (engagement flange portions 134) are engaged with engagement grooves 133.
Figure 10:
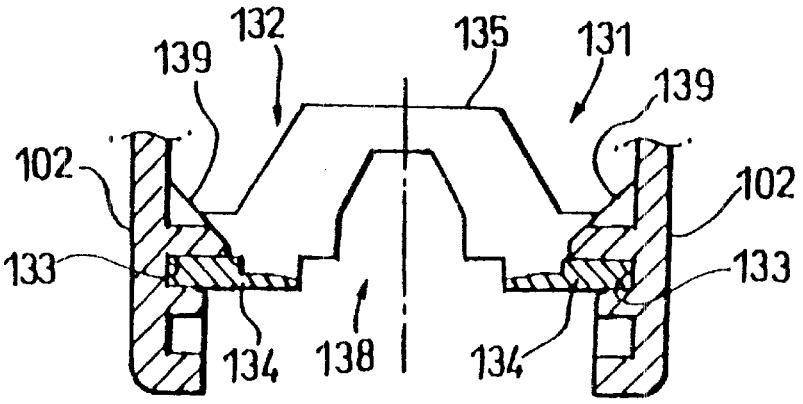
FIG. 10 is a similar vertical sectional view showing the state after the label guide piece 132 (engagement flange portions 134) are engaged with the engagement grooves 133.

FIG. 9 is a vertical sectional view of the label restraining and guiding system 131 portion taken perpendicular to the conveyance direction of the continuous label strip 113 and showing the state before the label guide piece 132 (engagement flange portions 134) are engaged with the engagement grooves 133. FIG. 10 is a similar vertical sectional view showing the state after the label guide piece 132 (engagement flange portions 134) are engaged with the engagement grooves 133. The space between the side plates 102 is made sufficient for receiving the width of the label guide piece 132. The label guide piece 132 can therefore be inserted between the side plates 102 to engage the engagement flange portions 134 in the engagement grooves 133 without need to detach and disassemble the side plates 102 in their entirety.

The stop portion 135 connects upstream ends of the engagement flange portions 134 and is formed substantially perpendicular to the plane including the engagement flange portion 134.

The deflection guide portion 136 connects the downstream ends of engagement flange portions 134. Its undersurface facing the aforesaid deflection member 109 is constituted as a deflection member-side inclined section 137 (FIG. 8) similar to the deflection member-side inclined section 119 of the aforesaid label guide piece 108.

Figure 11:
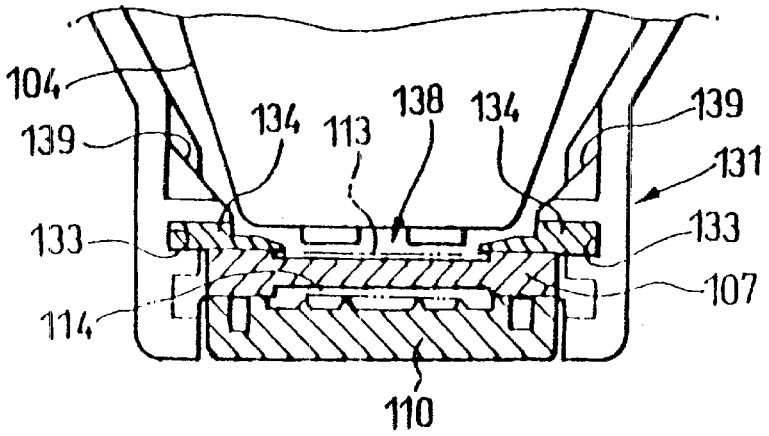
FIG. 11 is a vertical sectional view of the label restraining and guiding system 131 portion taken perpendicular to the conveyance direction of the continuous label strip 113 and showing the relationship among the label guide piece 132, a platen 107 and a bottom cover 110.

FIG. 11 is vertical sectional view of the label restraining and guiding system 131 portion taken perpendicular to the conveyance direction of the continuous label strip 113 and showing the relationship among the label guide piece 132, the platen 107 and the bottom cover 110. The surface of the platen 107, i.e., the surface on which the printer 104 prints, faces a vacant space 138 of the label guide piece 132 enclosed by the engagement flange portions 134, the stop portion 135 and the deflection guide portion 136.

As best shown in FIG. 10, the pair of left and right engagement grooves 133 have a depth enabling fitting of the engagement flange portions 134 of the label guide piece 132 therein, and projecting portions 139 of sectionally triangular shape are formed so as to project inward of the side plates 102 above the engagement grooves 133.

Figure 12:
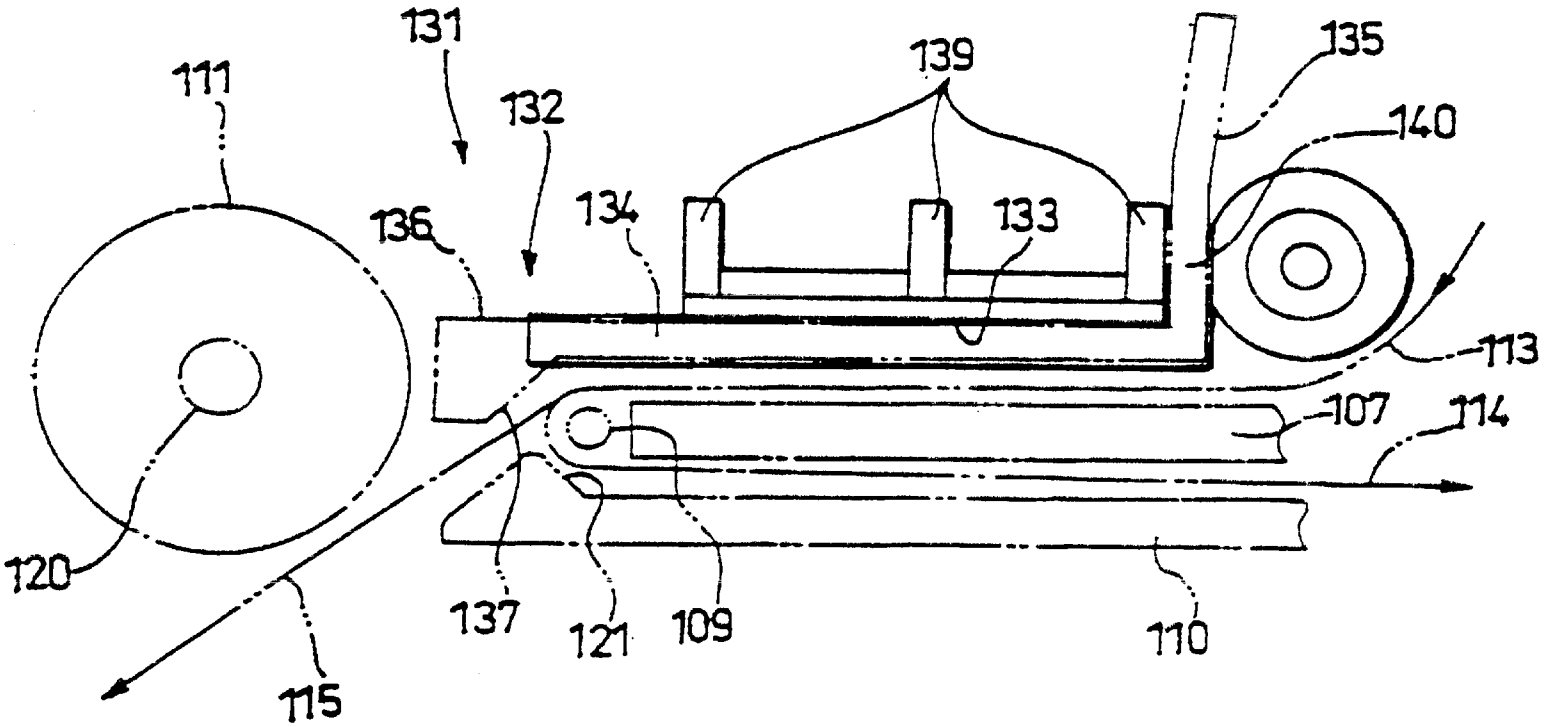
FIG. 12 is a vertical sectional view of the label restraining and guiding system 131 portion taken parallel to the conveyance direction of the continuous label strip 113.

FIG. 12 is a vertical sectional view of the label restraining and guiding system 131 portion taken parallel to the conveyance direction of the continuous label strip 113. Rear end portions 140 of the engagement grooves 133 rise vertically and the lateral ends of the stop portion 135 of the label guide piece 132 are fitted into these rear end portions 140. The entire label guide piece 132 can be located in a prescribed positional relationship with respect to the platen 107, the deflection member 109, and the bottom cover 110.

As will be understood from FIG. 8, the pair of left and right side plates 102 are fastened by five bolts, i.e., by a first bolt, 141 corresponding to the rotation shaft 120, a second bolt 142 above the rotation shaft 120, a third bolt 143 corresponding to the rotation shaft 117, a fourth bolt 144 near the label case 103, and a fifth bolt 145 located at the rear end portion of the side plates 102.

In the so-structured portable printing labeler 130 and label restraining and guiding system 131, at the time of replacing the label guide piece 132, the first bolt, 141, second bolt 142, third bolt 143, fourth bolt 144 and fifth bolt 145 are loosened to form a small gap between the pair of left and right side plates 102.

There is no need to detach or disassemble the side plates 102 or any of the internal mechanisms or components.

Next, as was explained with reference to FIG. 13, the bottom cover 110 is rotated clockwise around the rotation shaft 120 and the platen 107 is rotated counterclockwise around the rotation shaft 117, the engagement flange portions 134 are removed from the engagement grooves 133, and the label guide piece 132 is taken out.

When a new label guide piece 132 is to be installed, it is inserted into the space between the side plates 102 retained in the foregoing state, the engagement flange portions 134 are positioned for engagement with the engagement grooves 133 as shown in FIG. 9, and one of the engagement flange portions 134 is fitted into the associated engagement groove 133.

The projecting portions 139 projecting inward of the associated side plate 102 function as a stop when the engagement flange portion 134 is fitted into the engagement groove 133. In addition, the rear end portion 140 of the engagement groove 133 abuts on the stop portion 135. The label guide piece 132 can therefore be reliably positioned.

The other side plate 102 is then moved inward to fit the remaining engagement flange portion 134 in the other engagement groove 133, whereafter it is only necessary to tighten the first bolt 141, second bolt 142, third bolt 143, fourth bolt 144 and fifth bolt 145.

By this the assembled condition shown in FIGS. 11 and 12 can be achieved. Thus, as explained earlier, the label guide piece 132 can be installed and removed without totally dismantling the pair of left and right side plates 102 and while maintaining the other components substantially in their assembled condition. The replacement operation can therefore be carried out with utmost ease.

In addition, the label guide piece 132 is made: of synthetic resin and can therefore be manufactured at low cost. Even if it needs to be replaced frequently, this is not a problem because the replacement operation is simple. Moreover, since the label guide piece 132 is a laterally symmetrical and unitary, it can maintain adequate strength as a component and further enables simultaneous replacement of the members responsible for guiding both lateral edge portions of the continuous label strip 113.

Industrial Applicability

As set out in the forgoing, in accordance with the first aspect of the present invention, the label roll or the core is held by the spring plates and the core holding lug members so that both loading and removal can be effected as a single, simple operation and reliable holding performance can be achieved.

In accordance with the second aspect of the invention, the label guide piece can be engaged with and removed from the pair of left and right side plates. The label guide piece can therefore be easily replaced and can be inexpensively manufactured.

In accordance with the third aspect of the invention, when the protective cover is in the closed state, the label roll is locked and prevented from being inadvertently removed from the core holder even if an operation is attempted to move the core holding lug members in the direction of the core removal attitude.

Explanation of Symbols

1 Labeler (FIG. 1)
2 Label roll L core holder in labeler 1 (First embodiment; FIGS. 2 and 3)
3 Side plate
4 Operating lever
5 Bottom cover
6 Label conveyance roller
7 Printer
8 Ink roller
9 Labeling roller
10 Protective cover
11 Spring plate
12 Auxiliary spring
13 Core holding lug member
14 Shaft mounting portion of spring plate 11
15 Yoke-like shaft-supported arm of spring plate 11
16 Elastic abutment arm of spring plate 11
17 Transverse mounting shaft
18 Label holding space
19 Bearing portion of yoke-like shaft-supported arm 15
20 Rotation shaft of core holding lug member 13
21 Core holding portion of core holding lug member 13
22 Lug portion of core holding lug member 13
23 Tip abutment portion of elastic abutment arm 16
24 Rear surface abutment portion of core holding portion 21
25 Core holding surface of core holding portion 21

-continued

| Explanation of Symbols |
|---|
| 26 Core restraining projection of core holding portion 21 |
| 27 Cover body of protective cover 10 |
| 28 Arcuate portion of cover body |
| 29 Pair of semicircular portions of cover body 27 |
| 30 Open/close shaft of cover body 27 |
| 31 Hook portion of semicircular portion 29 |
| 32 Cover handle portion of semicircular portion 29 |
| 33 Triangular projecting piece for locking of semicircular portion 29 |
| 34 Shaft supporting hole portion of side plate 3 |
| 35 Hook engagement portion of side plate 3 |
| 36 Opening portion of protective cover 10 |
| 37 Conveyance path in labeler 1 |
| 40 Label roll L core holder in labeler 1 (Second embodiment; FIG. 6) |
| 41 Retaining projection portion of elastic abutment arm 16 |
| 50 Label roll L core holder in labeler 1 (Third embodiment; FIG. 7) |
| 51 First core holder portion of core holding lug member 13 |
| 52 Second core holder portion of core holding lug member 13 |
| 53 First core holding surface of first core holder portion 51 |
| 54 Second core holding surface of second core holder portion |
| C1 Core of label roll L |
| C2 Core of another label roll L |
| L Label roll |
| 101 Portable printing labeler (FIG. 13) |
| 102 Pair of left and right side plates |
| 103 Label case |
| 104 Printer |
| 105 Conveyance roller |
| 106 Label presser |
| 107 Platen |
| 108 Pair of left and right label guide pieces |
| 109 Deflection member (deflection pin) |
| 110 Bottom cover |
| 111 Labeling roller |
| 112 Label restraining and guiding system of printing labeler 101 |
| 113 Continuous label strip |
| 114 Backing sheet of continuous label strip |
| 115 Label of continuous label strip 113 |
| 116 Conveyance projection |
| 117 Rotation shaft of conveyance roller 105 and platen 107 |
| 118 Platen-side flat guide section of label guide piece 108 |
| 119 Deflection member-side inclined section of label guide piece 108 |
| 120 Rotation shaft of bottom cover 110 and labeling roller 111 |
| 121 Sloped guide portion of bottom cover 110 |
| 131 label restraining and guiding system of portable printing labeler 130 (Embodiment; FIG. 8) |
| 132 Laterally symmetrical label guide piece |
| 133 Pair of left and right engagement grooves of side plates 102 |
| 134 Pair of left and right engagement flange portions of label guide piece 132 |
| 135 Stop portion of label guide piece 132 |
| 136 Deflection guide portion of label guide piece 132 |

-continued

| Explanation of Symbols |
|---|
| 137 Deflection member-side inclined section of deflection guide portion 136 |
| 138 Vacant space of label guide piece 132 |
| 139 Sectionally triangular projecting portion of side plate 102 |
| 140 Rear end portion of engagement groove 133 |
| 141 First bolt |
| 142 Second bolt |
| 143 Third bolt |
| 144 Fourth bolt |
| 145 Fifth bolt |

What is claimed is:

1. In a label restraining and guiding system of a printing labeler having a deflection member for turning back only the backing sheet of a continuous label strip composed of a backing sheet having a label peel-off layer and a plurality of labels provisionally attached to the backing sheet to thereby peel the labels from the backing sheet, a platen that supports lateral end portions of the deflection member, a pair of left and right side plates that support the platen, and a label guide piece that faces the platen and guides the continuous label strip toward the deflection member, the label restraining and guiding system of the labeler characterized in that the label guide piece integrally has a pair of left and right engagement flange portions engageable with a pair of left and right engagement grooves formed in the pair of left and right side plates, a stop portion that connects upstream ends of the engagement flange portions, and a deflection guide portion that connects downstream ends of the engagement flange portions, and that a surface of the platen faces a vacant space enclosed by the engagement flange portions, the stop portion and the deflection guide portion.

2. A label restraining and guiding system of a labeler according to claim 1, characterized in that the label guide piece is formed to be laterally symmetrical.

3. A label restraining and guiding system of a labeler according to claim 1, characterized in that projecting portions projecting inward of the side plates are formed on the side plates above the engagement grooves.

4. A label restraining and guiding system of a labeler according to claim 1, characterized in that the stop portion of the label guide piece is formed substantially perpendicular to a plane including the engagement flange portions.

5. A label restraining and guiding system of a labeler according to claim 1, characterized in that the label guide piece is formed of synthetic resin.

* * * * *